US011697478B2

(12) United States Patent
Grall

(10) Patent No.: US 11,697,478 B2
(45) Date of Patent: Jul. 11, 2023

(54) SYSTEM FOR DEPLOYING AND RECOVERING AN AUTONOMOUS UNDERWATER DEVICE, METHOD OF USE

(71) Applicant: IXBLUE, Saint-Germain-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 70 days.

(21) Appl. No.: 17/050,588

(22) PCT Filed: Apr. 26, 2019

(86) PCT No.: PCT/FR2019/050990

§ 371 (c)(1),
(2) Date: Oct. 26, 2020

(87) PCT Pub. No.: WO2019/207263

PCT Pub. Date: Oct. 31, 2019

(65) Prior Publication Data

US 2021/0237838 A1 Aug. 5, 2021

(30) Foreign Application Priority Data

Apr. 27, 2018 (FR) ..... 1853733

(51) Int. Cl.
*B63C 7/16* (2006.01)
*B63B 27/00* (2006.01)
(Continued)

(52) U.S. Cl.
CPC ..... *B63C 7/16* (2013.01); *B63B 27/00* (2013.01); *B63B 41/00* (2013.01); *B63G 8/001* (2013.01);
(Continued)

(58) Field of Classification Search
CPC ... B63B 2027/165; B63B 27/36; B63B 27/00; B63B 41/00; B63G 2008/008;
(Continued)

(56) References Cited

U.S. PATENT DOCUMENTS 5,222,454 A 6/1993 Meyer
7,854,569 B1 * 12/2010 Stenson ..... B63G 8/001 405/188
(Continued)

FOREIGN PATENT DOCUMENTS

| | | |
|---|---|---|
| JP | 2003-026090 | 1/2003 |
| SU | 1154142 | 5/1985 |
| WO | 2018/065723 | 4/2018 |

OTHER PUBLICATIONS

International Search Report for PCT/FR2019/050990 dated Jul. 19, 2019, 7 pages.
(Continued)

*Primary Examiner* — Andrew Polay
(74) *Attorney, Agent, or Firm* — Nixon & Vanderhye

(57) ABSTRACT

A system for deploying and recovering an autonomous underwater device (AUD) using a surface carrier ship, includes, in addition to the carrier ship, a subaquatic vehicle (SV) guided by a connection wire connected to the carrier ship, the SV able to be positioned in a storage configuration wherein the SV is fixedly but removably joined to the carrier ship in a storage zone, or in a configuration for use, in which the SV, separated from the carrier ship, is in the water and at a distance from the carrier ship while remaining connected by the connection wire, the SV including propulsion, guiding and stabilizing systems and a station for receiving the AUD allowing it to be removably attached to the SV, the receiving station and the AUD including a complementary automated docking unit allowing the AUD to automatically
(Continued)

Figure 1:
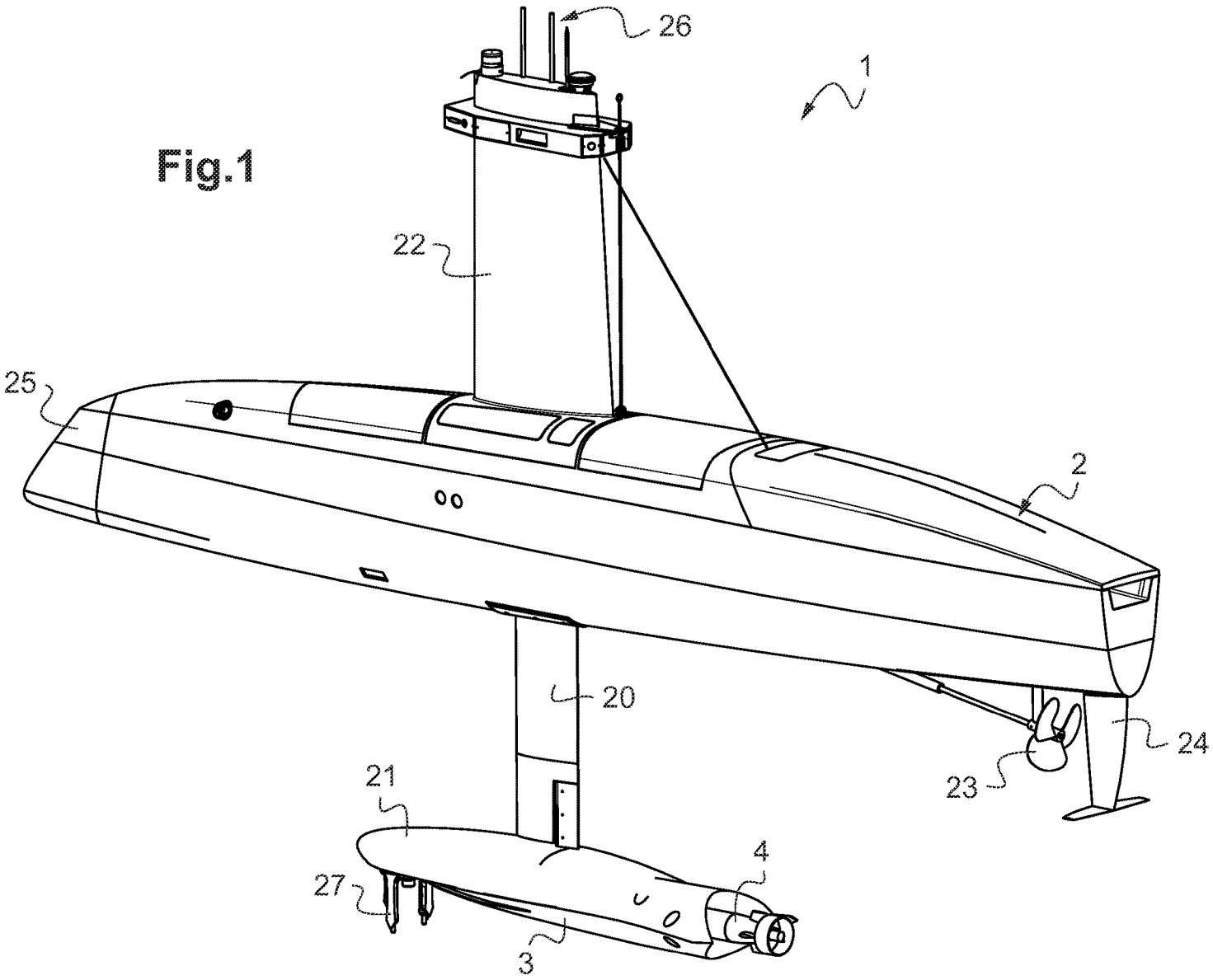

dock with the receiving station during recovery and attach itself thereto.

10 Claims, 11 Drawing Sheets

(51) Int. Cl.

| | |
|---|---|
| ***B63B 41/00*** | (2006.01) |
| ***B63G 8/00*** | (2006.01) |
| *B63B 27/16* | (2006.01) |
| *B66C 13/02* | (2006.01) |
| *B66C 23/52* | (2006.01) |

(52) U.S. Cl.
CPC .. *B63B 2027/165* (2013.01); *B63G 2008/004* (2013.01); *B63G 2008/007* (2013.01); *B63G 2008/008* (2013.01); *B66C 13/02* (2013.01); *B66C 23/52* (2013.01)

(58) Field of Classification Search
CPC ..... B63G 8/001; B63G 2008/004; B63G 2008/007; B63C 7/16; B66C 13/02; B66C 23/52
See application file for complete search history.

(56) References Cited

U.S. PATENT DOCUMENTS

| | | | | |
|---|---|---|---|---|
| 2007/0051292 | A1 | 3/2007 | Kilbourn et al. | |
| 2012/0160143 | A1* | 6/2012 | Bailey ..... | B63B 21/66 114/61.1 |
| 2012/0167814 | A1 | 7/2012 | Kalwa | |

OTHER PUBLICATIONS

Written Opinion of the ISA for PCT/FR2019/050990 dated Jul. 19, 2019, 7 pages.

* cited by examiner

SYSTEM FOR DEPLOYING AND RECOVERING AN AUTONOMOUS UNDERWATER DEVICE, METHOD OF USE

TECHNICAL FIELD TO WHICH THE INVENTION RELATES

The present invention generally relates to the field of subaquatic exploration, monitoring and measurement systems, as well as the field of naval defence. It more particularly relates to a system for launching and recovering preprogramed and/or remotely operated, autonomous, subaquatic vehicles for exploration, detection, monitoring and measurement, as well as for naval defence in water environment. It is applicable in fresh water or in marine environment, sea, ocean, lake, and more generally, in any stretch of water. It may for example be implemented during subaquatic topographic or seismographic measurement campaigns using sonars or hydrophones, exploration and monitoring campaigns using optical, laser or acoustic sensors, detection campaigns using magnetometers, mine action campaigns.

TECHNOLOGICAL BACKGROUND

The autonomous underwater vehicles are most often called AUV. Different systems are known for launching and recovering autonomous underwater vehicles from carrier ships or from the land. Those systems can be launch and recovery ramps, floating or hanging baskets, or simply lifting equipment such as cranes or gantries. Such systems are efficient for the launching of autonomous underwater vehicles but less efficient for the recovery thereof.

One of the difficulties relates to the docking of the autonomous underwater vehicle for the recovery thereof. Indeed, whether ramps or handling are used, it is most of the time necessary to previously dock the autonomous underwater vehicle. Now, it is difficult or even sometimes impossible to dock a vehicle on the sea from a ship without the operation is performed by men, which represents a high risk and is impossible to perform when it is desired to recover an autonomous underwater vehicle from a ship that is autonomous or remotely operated.

Other existing systems are similar to baskets into which the autonomous underwater vehicle is received before being hoisted on-board, still other ones are ramps with conveyor belt on which the autonomous underwater vehicle runs aground before being hoisted on-board by the conveyor belt.

One of the drawbacks of all these systems lies in the movements of the recovery means. Either these movements are imparted to this recovery tool by the carrier ship, or by the waves in the case of floating baskets.

Moreover, different automated docking systems exist, called "Homing", allowing the automatic docking of an autonomous underwater vehicle on or in a docking station. These automated docking systems conventionally use acoustic and/or optic signals for the autonomous underwater vehicle to find and recognize the location of the docking station and to be able to communicate with said docking station. They are efficient if and only if the docking station is almost stationary.

Recovery and/or docking systems for autonomous underwater vehicles are known from the following documents: U.S. Pat. No. 7,854,569, US 2012/167814, JP 2003 02 6090 et WO 2018 065 723, US 2007/051292, SU 1 154 142, U.S. Pat. No. 5,222,454.

OBJECT OF THE INVENTION

In order to remedy the above-mentioned drawbacks of the state of the art, the present invention proposes a subaquatic remotely operated vehicle (ROV) system, which is operated by wireline, hence wire-guided, and which remains under the water at the time of launching and recovery of the autonomous underwater vehicle. Before the launching and after the recovery, the autonomous underwater vehicle is transported by the subaquatic vehicle. After the launching and before the recovery, the autonomous underwater vehicle is separated from the subaquatic vehicle and is able to navigate autonomously.

Outside the periods of launching and recovery of the autonomous underwater vehicle, the wire-guided subaquatic vehicle can be brought back on or in or against the carrier ship for being stored with or, possibly, without its autonomous underwater vehicle.

The subaquatic vehicle is motorized and includes propelling and guiding means, and it is capable, thanks to stabilizing means, to maintain its position under water according to all the axes, that is to say three axes, i.e. six degrees of freedom, and it is hence not subjected to the wave and carrier ship movements during the autonomous underwater vehicle launching and recovery, because it is submerged.

The subaquatic vehicle includes a docking station in or against which at least one autonomous underwater vehicle can be automatically housed. This docking station has generally a shape close to that of a cylinder with a flared mouth, i.e. funnel-shaped, and is equipped with an automated docking system for the autonomous underwater vehicle. This subaquatic vehicle with a docking station can be launched from a manned or unmanned carrier ship and, in this latter case, an autonomous or wire-guided or towed carrier ship.

Hence, the invention firstly relates to a system for launching and recovering an autonomous underwater vehicle using a surface carrier ship, the carrier ship including a hull with a bottom, the autonomous underwater vehicle including propelling, guiding and stabilizing means.

According to the invention, the system includes, in addition to the carrier ship, a subaquatic vehicle wire-guided by a connection wire connected to the carrier ship, wherein the subaquatic vehicle can be positioned in two main configurations, a storage configuration in which the subaquatic vehicle is removably attached to the carrier ship in a storage area of the carrier ship and a use configuration in which the subaquatic vehicle, separated from the carrier ship, is in water and remote from the storage area of the carrier ship, while remaining connected to the carrier ship by the connection wire, said subaquatic vehicle including propelling, guiding and stabilizing means and a docking station for the autonomous underwater vehicle, allowing a removable attachment of the autonomous underwater vehicle to the subaquatic vehicle for transporting the autonomous underwater vehicle to its launching location, where it will be released from the subaquatic vehicle, the subaquatic vehicle and the autonomous underwater vehicle including complementary automated docking means allowing the launched autonomous underwater vehicle to automatically dock with the docking station of the subaquatic vehicle during the recovery and to attach thereto.

Other non-limitative and advantageous material and functional features of the system according to the invention, taken individually or according to all the technically possible combinations, are the following:

the connection wire is removable from the subaquatic vehicle, the connection wire is removable from the carrier ship, the connection wire is intended for the power supply of the subaquatic vehicle, the connection wire is intended for the power supply, in particular for charging electric batteries, of the autonomous underwater vehicle, the connection wire is intended for data exchanges between the subaquatic vehicle and the carrier ship, the connection wire is intended for data exchanges between the autonomous underwater vehicle and the carrier ship through the subaquatic vehicle, the data are measurement and/or control data, the subaquatic vehicle is wire-guided by a connection wire from the carrier ship, the carrier ship includes a connection wire winder/unwinder, the connection wire winder/unwinder is out of water, in or on the carrier ship, the autonomous underwater vehicle includes at least one proper/integrated propelling means, the autonomous underwater vehicle includes at least one proper/integrated guiding means, the autonomous underwater vehicle includes at least one proper/integrated stabilizing means, the propelling, guiding and stabilizing means of the autonomous underwater vehicle make it possible to control displacements according to six degrees of freedom, the subaquatic vehicle includes at least one proper/integrated propelling means, the subaquatic vehicle includes at least one proper/integrated guiding means, the subaquatic vehicle includes at least one proper/integrated stabilizing means, the propelling, guiding and stabilizing means of the subaquatic vehicle make it possible to control displacements according to six degrees of freedom, the carrier ship includes at least one proper/integrated propelling means, the carrier ship includes at least one proper/integrated guiding means, the carrier ship includes at least one proper/integrated stabilizing means, the propelling and guiding means of the carrier ship make it possible to control displacements according to three degrees of freedom, the propelling, guiding and stabilizing means of the subaquatic vehicle make it possible to control displacements according to four degrees of freedom, the propelling means allow the displacement of the carrier ship, the subaquatic vehicle, the autonomous underwater vehicle according to the case, the guiding means allow the steering of the carrier ship, the subaquatic vehicle, the autonomous underwater vehicle according to the case, the stabilizing means allow the positioning of the carrier ship, the subaquatic vehicle, the autonomous underwater vehicle according to the case, the stabilizing means allow the positioning to a fixed point of the carrier ship, the subaquatic vehicle, the autonomous underwater vehicle according to the case, the stabilizing means allows the positioning in constant displacement and orientation of the carrier ship, the subaquatic vehicle, the autonomous underwater vehicle according to the case, in particular the launching and the recovery of the autonomous underwater vehicle can be made whereas the subaquatic vehicle is in constant displacement and orientation, the stabilizing means include sensors, including an inertial unit and a calculator to control the propelling and guiding means as a function of positioning instructions, the propelling means is a mechanical propelling device that includes one or several electric and/or internal combustion and/or chemical engines and that operate(s) directly or indirectly one or several propellers or one or several turbines, the propelling device includes one or several turbines, or propellers, the turbine(s) allow a jet/reaction propelling, the rotation direction of the propeller or the turbine can be reversed, the guiding means are chosen among the devices of the rudder, wing, flap or even propeller type, the propelling and guiding means are either distinct, or combined within single devices, in this latter case these combined means are in particular steerable propellers, the carrier ship and/or the subaquatic vehicle and/or the autonomous underwater vehicle include(s) guiding devices that are distinct from the propelling means, the guiding devices being chosen among, in particular, rudders, wings, flaps, the propelling, guiding and stabilizing means comprise at least one ballast, the carrier ship includes no proper/integrated propelling means, the carrier ship moving thanks to the propelling means of the subaquatic vehicle and/or of the autonomous underwater vehicle when the latter is in storage configuration with the autonomous underwater vehicle that has been recovered, the carrier ship includes no proper/integrated propelling means, the carrier ship moving thanks to the propelling means of the subaquatic vehicle when the latter is in storage configuration without the autonomous underwater vehicle, which has been launched, the carrier ship includes no proper/integrated propelling means, the carrier ship being steered thanks to the guiding means of the subaquatic vehicle and/or of the autonomous underwater vehicle, the autonomous underwater vehicle is preprogramed or remotely operated/remote-controlled, the autonomous underwater vehicle includes a body, the autonomous underwater vehicle includes a body elongated in the length direction and has a length comprised between 0.5 m and 8 m, the autonomous underwater vehicle includes a body elongated in the length direction and has a maximum width of the body, excluding the external appendix(ces), comprised between 0.07 m and 1.5 m, the autonomous underwater vehicle includes a body elongated in the length direction.

the autonomous underwater vehicle includes at least one fixed or steerable external appendix, the autonomous underwater vehicle includes at least one removable external appendix between a retracted position, inside the body volume, and an extended position, outside the body, the appendix of the autonomous underwater vehicle is in particular a wing or a flap, the elongated body of the autonomous underwater vehicle is substantially cylindrical, the rear part of the autonomous underwater vehicle includes at least one propeller, the rear part of the autonomous underwater vehicle includes a steering means, in particular rudder and/or steerable propeller(s), the autonomous underwater vehicle includes at least one sensor, the subaquatic vehicle can surface and float, the subaquatic vehicle has a substantially elongated spindle general shape, the subaquatic vehicle has a parallelepipedal shape, the subaquatic vehicle has a substantially cylindrical and elongated general shape, the subaquatic vehicle has two opposite ends, a front end and a rear end, the subaquatic vehicle has no hull and is an open chassis/frame structure, the subaquatic vehicle includes a hull, the subaquatic vehicle hull is substantially cylindrical, the subaquatic vehicle hull is substantially ovoid, the subaquatic vehicle hull has a vertical flat, the maximum height of the hull being lower than the maximum width of the hull, excluding the external appendix(ces), the subaquatic vehicle has an external shape substantially symmetrical with respect to the front-rear median vertical plane, the subaquatic vehicle includes a hull elongated in the length direction and has a length comprised between 1 m and 8.5 m, the subaquatic vehicle includes a hull elongated in the length direction and the maximum width of the hull, excluding the external appendix(ces), comprised between 0.3 m and 3 m, the subaquatic vehicle includes a hull elongated in the length direction and the maximum height of the hull, excluding the external appendix(ces), comprised between 0.3 m and 3 m, the subaquatic vehicle includes at least one fixed or steerable external appendix, the subaquatic vehicle includes at least one removable external appendix between a retracted position, inside the hull volume, and an extended position, outside the body, the appendix of the subaquatic vehicle is in particular a wing or a flap, the rear part of the subaquatic vehicle includes at least one propeller, the rear part of the subaquatic vehicle includes a steering means, in particular rudder and/or steerable propeller(s), the subaquatic vehicle includes several propellers steerable according to several degrees of freedom, the subaquatic vehicle includes at least one sensor, said at least one sensor of the subaquatic vehicle is directional, the directional sensor is chosen among a sonar, an optical detector, a video camera, a camera, un inertial device, an electronic compass, the subaquatic vehicle includes at least one attitude sensor, the subaquatic vehicle is intended to perform acoustic measurements and it includes acoustic measurement systems containing acoustic wave transmitting and receiving transducers, the carrier ship is a surface ship, the carrier ship includes a hull with a bottom, the carrier ship is substantially symmetrical with respect to a front-rear median vertical plane, the carrier ship is manned, the carrier ship is unmanned, the carrier ship is towed, the carrier ship is wire-guided, the carrier ship is autonomous, the carrier ship is drone, the carrier ship is preprogramed or remotely operated/remote-controlled, the carrier ship includes a programmable travel/trajectory control automaton, the carrier ship includes at least one fixed or steerable external appendix, the carrier ship includes at least one removable external appendix between a retracted position, inside the body volume, and an extended position, outside the body, the external appendix of the carrier ship is submerged, under the waterline, the appendix of the carrier ship is a keel, the submerged appendix of the carrier ship is a keel, and the subaquatic vehicle is stored at the lower end of the keel, in the subaquatic vehicle storage configuration, the subaquatic vehicle is arranged in a storage area of the carrier ship, the storage area being, according to the case, in water/submerged or out of water or partly out of water, in the subaquatic vehicle storage configuration, the subaquatic vehicle is arranged in a storage area of the carrier ship, wherein the storage area is chosen among a submerged recess of the bottom or of an appendix of the carrier ship hull, a submerged end of an appendix of the carrier ship hull, a location at least partly submerged on or under a submerged bottom of the carrier ship, a location out of water of the carrier ship, in the subaquatic vehicle use configuration, the subaquatic vehicle is under the water and remote from the storage area of the carrier ship, in the subaquatic vehicle storage configuration, the subaquatic vehicle is arranged partly out of water on or in the carrier ship, the immersed portion of the subaquatic vehicle in storage configuration being that which includes the propelling means of the subaquatic vehicle, in the subaquatic vehicle storage configuration, the subaquatic vehicle is arranged is a recess formed in the bottom of the carrier ship, the subaquatic vehicle remaining submerged in storage configuration, under the carrier ship, in the subaquatic vehicle storage configuration, the subaquatic vehicle is arranged against an end of an appendix of the carrier ship, said end being under the waterline of the carrier ship so that the subaquatic vehicle remains submerged in storage configuration, preferably the appendix being a keel of the carrier ship and the end of the appendix being the lower end of the keel, the appendix of the keel type of the carrier ship is fixed or removable and the subaquatic vehicle is positioned against the fixed or removable keel of the carrier ship in storage configuration, the lower end of the keel further includes a measurement bulb or gondola including underwater measurement devices, the subaquatic vehicle coming in position against the bulb or the gondola in storage configuration, in the subaquatic vehicle storage configuration, the subaquatic vehicle is placed in a recess formed in an appendix of the carrier ship, said recess being under the waterline of the carrier ship so that the subaquatic vehicle remains submerged in storage configuration, the appendix including a recess is a keel of the carrier ship and the recess is arranged at the lower end of the keel, the gondola or the bulb includes at least one acoustic antenna and, potentially, any other type of sensor, the carrier ship includes in its bottom a recess intended for storing the subaquatic vehicle, the subaquatic vehicle remaining submerged in storage configuration, against the hull or under the carrier ship, the recess and the subaquatic vehicle have such shapes that the subaquatic vehicle is stored into the recess so that the hydrodynamic drag of the carrier ship is modified by less than 40% with respect to the same carrier ship, but without recess and storing no subaquatic vehicle, at least one of the propelling means of the subaquatic vehicle is arranged on the rear of said subaquatic vehicle and the carrier ship includes a rear end wall and the recess is open on the rear end wall of the carrier ship so that, when the subaquatic vehicle is stored into the recess, the propelling means of the subaquatic vehicle is arranged more on the rear than the rear end wall of the carrier ship and can participate to the propulsion of said ship, the shapes of the bottom and subaquatic vehicle recesses are adapted so that, in storage configuration, the resistance to forward motion of the carrier ship is low, in storage configuration, the subaquatic vehicle is attached to the carrier ship in the recess of the carrier ship hull, the connection wire passes through the carrier ship hull in the recess of the carrier ship hull, the connection wire passes through the hull of the carrier ship through a passage well opening to the recess, in storage configuration, the propelling and, possibly, guiding and/or stabilizing means of the subaquatic vehicle participate, when activated, to the propulsion of the carrier ship and, possibly, to the guiding and/or the stabilization, the carrier ship has no keel, the carrier ship includes a hull longitudinally elongated from the rear to the front and includes floating portside lateral edge (G) and starboard lateral edge (D) and a submerged bottom connected to the two lateral edges, the two floating lateral edges and the submerged bottom defining an inner space of the carrier ship, the inner space being submerged at least in rear part, and the two rear ends of the floating lateral edges are separated by an opening towards the rear of the carrier ship, wherein the opening is limited downward by the submerged bottom, and the submerged bottom further includes at least one longitudinally elongated slot open towards the rear and intended for the passage of a lower axial wing of the subaquatic vehicle and the carrier ship is configured so that at least the front part of the subaquatic vehicle can engage into the inner space with the lower axial wing engaging into the slot through the rear end of the slot, the submerged bottom in rear part of the carrier ship is a ramp for launching and recovering the subaquatic vehicle, the two floating lateral edges join each other towards the front of the carrier ship so as to form a bow, the two floating lateral edges do not join each other towards the front of the carrier ship so as to form a catamaran with a central portion having a submerged bottom, the carrier ship includes a hull longitudinally elongated from the rear to the front and includes floating portside lateral edge (G) and starboard lateral edge (D) and a submerged bottom connected to the two lateral edges, the two floating lateral edges and the submerged bottom defining an inner space of the carrier ship, the inner space being submerged at least in rear part, and the two rear ends of the floating lateral edges are separated by an opening towards the rear of the carrier ship, wherein the opening is limited downward by the submerged bottom, and the submerged bottom further includes at least one longitudinally elongated slot open towards the rear and intended for the passage of a lower axial wing of the subaquatic vehicle that may surface and the carrier ship is configured so that at least the front part of the subaquatic vehicle that may surface, including the lower axial wing, can engage, by floating, into the inner space with the lower axial wing engaging into the slot through the rear end of the slot, the carrier ship includes a hull longitudinally elongated from the rear to the front and includes floating portside lateral edge (G) and starboard lateral edge (D) and a submerged bottom at least in rear part, i.e. a bottom at least partly submerged and under the waterline, connected to the two lateral edges, the two floating lateral edges and the submerged bottom defining an inner space of the carrier ship, said inner space being at least partly submerged, and the two rear ends of the floating lateral edges are separated by an opening towards the rear of the carrier ship, wherein the opening is limited downward by the submerged bottom, and the submerged bottom further includes at least one longitudinally elongated slot open towards the rear and intended for the passage of an axial wing of the subaquatic vehicle, said wing being a lower one and extended downward under the underside of the subaquatic vehicle, in the case where the subaquatic vehicle is intended to be stored into the inner space on the bottom of the carrier ship, and/or said wing being an upper one and extending upward on the top of the subaquatic vehicle, in the case where the subaquatic vehicle is intended to be stored under the bottom of the carrier ship, said wing engaging into the slot through the rear end of the slot, the subaquatic vehicle includes an upper axial wing and a lower axial wing, the subaquatic vehicle includes either an upper axial wind, or a lower axial wing, the axial wing includes at its upper end for the upper axial wing or at its lower end for the lower axial wing a widening preventing the axial wing to exit from the slot by vertical translation, once the wing engaged into the slot, the subaquatic vehicle fully engages into the inner space of the carrier ship in storage configuration, only the rear part of the subaquatic vehicle does not engage into the inner space of the carrier ship in storage configuration, the submerged bottom includes portions of complementary shape with respect to that of the adjacent shape of the subaquatic vehicle hull, the front part of the bottom is out of water and the rear part of the bottom is submerged, the bottom is totally submerged, the rear of the longitudinally elongated slot of the submerged bottom through which the axial wing is introduced during the engagement of the subaquatic vehicle into the inner space of the carrier ship has a funnel or Y-shape, with an introduction inlet widened towards the rear, the front of the longitudinally elongated slot of the submerged bottom is closed and forms a stop for the axial wing of the subaquatic vehicle so as to limit the engagement of the subaquatic vehicle into the inner space of the carrier ship, the longitudinally elongated slot of the submerged bottom includes a position locking means that is removable in order to allow the slot to be closed at the rear of the axial wing once the subaquatic vehicle engaged into the inner space of the carrier ship, the longitudinally elongated slot of the submerged bottom includes a position locking means that is removable in order to allow the slot to be closed at the rear of the axial wing once the subaquatic vehicle fully engaged into the inner space of the carrier ship, the edges of the longitudinally elongated slot of the submerged bottom are covered with an at least damping material, the carrier ship includes a hull at least partly inflatable, the floating portside lateral edge (G) and starboard lateral edge (D) of the carrier ship hull are consisted of at least one inflatable bladder, potentially divided into compartments, the carrier ship includes, in the inner space, inflatable and deflatable cushions, said cushions, once inflated, being intended to support and/or hold and/or block the subaquatic vehicle inside the inner space, the inflatable and deflatable cushions are arranged on the bottom, the inflatable and deflatable cushions are arranged against the inflated bladder forming the lateral edges, the carrier ship includes a full, rigid hull, the carrier ship includes a keel, the keel is a measurement keel including at least measurement instruments, the keel is a keel for the storage of the subaquatic vehicle, wherein the subaquatic vehicle can be removably attached to the keel, the keel is a measurement and storage keel, the carrier ship is single-hull, the carrier ship includes a hull with a bottom, the hull being topped with a deck, the hull being elongated between a bow and a stern along a longitudinal direction of the carrier ship, the deck corresponds to the upper level, out of water, in free air, of the carrier ship, the carrier ship is a wave-piercing ship, the hull of the carrier ship is substantially spindle-shaped with a tapered stern in order to form the single-hull wave-piercing ship, the deck has an upwardly convex surface, the bow of the single-hull wave-piercing ship tapers into a point, the bow of the single-hull wave-piercing ship tapers into a blade, the stern of the single-hull wave-piercing ship is flat, the single-hull wave-piercing carrier ship includes a ballasted keel, the single-hull wave-piercing ship has a configuration that allows it to navigate at speeds corresponding to a Froude number higher than 0.45, the Froude number is the ratio between the bottom length and the speed, the single-hull wave-piercing carrier ship has a total width to total length ratio lower than 0.2 and a maximum length lower than 20 metres, said length and width being respectively considered along the longitudinal direction of the carrier ship and a horizontal transverse direction, perpendicular to the longitudinal direction, the single-hull wave-piercing carrier ship has a ratio between the height above the waterline of the hull acting as a float and excluding its potential appendices, hence excluding a potential wheelhouse, and the height under the waterline of the hull acting as a float and excluding the potential appendices, hence excluding the keel, that is lower than 0.8 and higher than 0.1, the single-hull wave-piercing carrier ship has a length of at least 2.5 metres, the carrier ship is provided with a fixed keel, the carrier ship is provided with a removable keel, the removable keel is liftable, the removable keel can be lifted by translation from the bottom to the top, the keel is removable and can be lifted at least in part through the hull by translation from the bottom to the top or, conversely, lowered under the hull, the carrier ship includes, in its lower portion, a removable keel and, in its upper portion, a wheelhouse erected above the deck, the removable keel being able to be lowered under the hull and lifted at least partly through the hull, the removable hull having a lower end and an upper end, the wheelhouse includes internally a keel storage space and the removable keel and the keel storage space of the wheelhouse are arranged in alignment so that the removable keel can be lifted by upward translation at least in part in the keel storage space of the wheelhouse, so as to be able to lift the subaquatic vehicle against the carrier ship bottom and, preferably, in a recess of the carrier ship bottom, the removable keel and the keel storage space of the wheelhouse have aligned main axes that are vertical, the removable keel and the keel storage space of the wheelhouse have aligned main axes that are inclined with respect to the vertical, the removable keel and the keel storage space of the wheelhouse have aligned main axes that are perpendicular to the main longitudinal extent of the carrier ship, the removable keel and the keel storage space of the wheelhouse have aligned main axes that are inclined with respect to the main longitudinal extent of the carrier ship, the main axis of the wheelhouse and the main axis of the keel storage space of the wheelhouse are parallel and, preferably, collinear to each other, the wheelhouse includes the keel storage space in its lower portion and equipment in its upper portion, the carrier ship hull includes a keel well allowing at least the lowering and lifting passage of the removable keel, the keel storage space of the wheelhouse is in alignment with a keel well opening downward from the hull and whose walls rise above the waterline of the carrier ship, the removable keel being slidable in said keel well, the keel well is flooded up to the waterline, the carrier ship includes sealing means between the connection portion of the removable keel and the hull in order to create, in the keel well, a space under the waterline that is out of water, a tight flexible skirt is extended between the upper end of the removable keel and the carrier ship hull, a tight flexible skirt is extended between the lower end of the connection portion of the removable keel and the carrier ship hull, the flexible skirt is a accordion skirt, the flexible skirt is elastic, the wheelhouse is partly intended to receive the removable keel and the keel storage space of the wheelhouse represents at least 75% of the whole volume of the wheelhouse, the height of the wheelhouse placed on the deck or the superstructures of the carrier ship is such that the top of the latter is located at a minimum altitude of 1.5 metres above the deck when the carrier ship is vertical, the wheelhouse may be closed over its whole surface, the wheelhouse may be open over a part of its surface, the wheelhouse has an aerodynamic shape, the keel has a hydrodynamic shape, the wheelhouse has a height (with respect to its base) to width (in the direction transverse to the displacement axis of the ship) ratio higher than 3, the fixed or removable keel includes at its lower end a bulb or a gondola, the bulb or the gondola including a recess intended for the storage of the subaquatic vehicle, the fixed or removable keel includes at its lower end a bulb or a gondola longitudinally elongated and connected to the upper end of the keel by a connection portion of the keel of longitudinal extend lower than the longitudinal extent of the bulb or the gondola, when the removable keel is lifted into the wheelhouse, the bulb or the gondola remains under the hull, the bulb or the gondola includes at least measurement instruments, the carrier ship includes a attitude measurement unit including attitude measurement sensors, the attitude measurement sensors are arranged in or against the keel bulb or gondola, the carrier ship is intended to perform acoustic measurements and it includes acoustic measurement systems including acoustic wave transmitting and receiving transducers, the acoustic wave transmitting and receiving transducers are arranged in or against the keel bulb or gondola, the bulb or the gondola includes an upper face turned upward and the hull and a lower face turned downward and the hull includes a recess at the connection between the hull and the removable keel, wherein said recess can house at least the upper face of the bulb or the gondola when the removable keel is lifted, the hull recess may house the bulb or the gondola in totality when the removable keel is lifted, the bulb or the gondola being then comprised in the general volume of the carrier ship hull, the hull recess may house the bulb or the gondola in totality and at least a part of the subaquatic vehicle when the removable keel is lifted, the bulb or the gondola and the subaquatic vehicle being then comprised in the general volume of the carrier ship hull, the carrier ship includes an attitude measurement unit including attitude measurement sensors and at least attitude measurement sensors are arranged in or against the keel bulb or gondola, the maximum width of the connection portion of the keel is lower than or equal to the maximum width of the bulb or the gondola, the maximum length of the connection portion being lower than the maximum length of the bulb or the gondola, said length and width being respectively considered along the longitudinal direction of the carrier ship and a horizontal transverse direction perpendicular to the longitudinal direction, the ratio between the maximum width of the connection portion and the maximum width of the bulb or the gondola is comprised between 0.05 and 0.5, the connection portion of the keel has a substantially identical length over its whole height, the connection portion of the keel has a substantially identical maximum width over its whole height, the connection portion of the keel has a uniform cross-section over its height, the cross-section of the connection portion of the keel is circular, ovoid or spindle-shaped, in the subaquatic vehicle storage configuration, the subaquatic vehicle is arranged out of water on or in the carrier ship, said carrier ship including a subaquatic vehicle recovery device, in the subaquatic vehicle storage configuration, the subaquatic vehicle is arranged out of the water on the deck of the carrier ship, the subaquatic vehicle recovery device includes a launch and recovery/towing ramp, the subaquatic vehicle recovery device includes a towing gantry or crane, the carrier ship includes a subaquatic vehicle recovery device making it possible to take it out of water and, conversely, to launch said subaquatic vehicle to water, the subaquatic vehicle and the carrier ship include unlockable complementary locking means, making it possible to removably couple or stow the subaquatic vehicle to the carrier ship in order, in storage configuration, to removably attach the subaquatic vehicle to the carrier ship, the locking means provide a complete stowing of the subaquatic vehicle to the carrier ship, the subaquatic vehicle has a general shape elongated along a main vehicle axis, said general shape defining a vehicle volume, and the docking station of the autonomous underwater vehicle is arranged in a payload enclosure having a general shape elongated along a main enclosure axis, the autonomous underwater vehicle being housed in said payload enclosure, the payload enclosure is open to the outside, the subaquatic vehicle includes at least one payload enclosure, each enclosure including at least one docking station for a autonomous underwater vehicle, the payload enclosure is a lateral opening in the subaquatic vehicle hull and the autonomous underwater vehicle boards or leaves the docking station of the subaquatic vehicle laterally to the latter, the lateral opening is portside, starboard or a lower opening, the payload enclosure includes a rear longitudinal end opening of the subaquatic vehicle hull and the autonomous underwater vehicle boards or leaves the docking station of the subaquatic vehicle by the rear of the latter, the payload enclosure includes a front longitudinal end opening of the subaquatic vehicle hull and the autonomous underwater vehicle boards or leaves the docking station of the subaquatic vehicle by the front of the latter, the payload enclosure includes a wall including a slot for guiding an axial wing of the autonomous underwater vehicle, in order to allow the guiding of the autonomous underwater vehicle when the latter enters the enclosure to join the docking station, the autonomous underwater vehicle fully engages within the payload enclosure, the autonomous underwater vehicle partially engages within the payload enclosure, the rear portion of the autonomous underwater vehicle exiting from said enclosure, the docking station allows the autonomous underwater vehicle to be removable attached to the subaquatic vehicle, the docking station and the autonomous underwater vehicle include automated complementary docking means allowing the autonomous underwater vehicle to automatically dock with the docking station during the recovery of the autonomous underwater vehicle.

The invention also proposes a subaquatic vehicle specially configured for the system for the invention. The subaquatic vehicle may be made according to all the mentioned embodiments.

The invention also proposes a carrier ship specially configured for the system of the invention. The carrier ship may be made according to all the mentioned embodiments and is a surface ship.

The invention also proposes a docking station for an autonomous underwater vehicle adaptable to an existing subaquatic vehicle in order to make the system according to the invention from an existing subaquatic vehicle, said existing subaquatic vehicle being wire-guided by a connection wire connected to a carrier ship, said docking station allowing a removable attachment of the autonomous underwater vehicle to the subaquatic vehicle for transporting the autonomous underwater vehicle to its launching location, where it will be released from the subaquatic vehicle, the docking station and the autonomous underwater vehicle including automated complementary docking means allowing the autonomous underwater vehicle to automatically dock with the docking station during the recovery of the autonomous underwater vehicle.

The invention finally relates to a method for launching and recovering an autonomous underwater vehicle using a surface carrier ship, the carrier ship including a hull with a bottom, the autonomous underwater vehicle including propelling means, method in which is implemented the system of the invention with a subaquatic vehicle wire-guided by a connection wire connected to the carrier ship, said subaquatic vehicle including propelling, guiding and stabilizing means and a docking station allowing a removable attachment of the autonomous underwater vehicle to the subaquatic vehicle, wherein the subaquatic vehicle can be positioned in two main configurations, a storage configuration in which the subaquatic vehicle is removably attached to the carrier ship in a storage area of the carrier ship and a use configuration in which the subaquatic vehicle, separated from the carrier ship, is in water and remote from the storage area of the carrier ship, while remaining connected to the carrier ship by the connection wire, and, for the launching, the autonomous underwater vehicle is released from the docking station when the subaquatic vehicle is submerged and in use configuration, and for the recovery, the autonomous underwater vehicle is automatically recovered into the docking station when the subaquatic vehicle is submerged and in use configuration, the subaquatic vehicle and the autonomous underwater vehicle including automated complementary docking means allowing the launched autonomous underwater vehicle to automatically with the docking station of the subaquatic vehicle.

Thanks to the invention, the launching and recovery of the autonomous underwater vehicle are simplified because it is no longer necessary to handle it for releasing it or grabbing/catching it in water from a ship that is undergone to the sea movements, wind gusts . . . . The autonomous underwater vehicle is recovered or released under water from the subaquatic vehicle that is connected by a wire to the carrier ship, hence allowing a decoupling of the respective movements of the subaquatic vehicle and the carrier ship. Moreover, the subaquatic vehicle includes means, in particular stabilizing means, facilitating the action of the automated docking means between the subaquatic vehicle and the autonomous underwater vehicle. The recovery of the subaquatic vehicle for storage on or in or under the carrier ship and the launching in water/releasing thereof, are also particularly simple due to the wire connection between the carrier ship and the subaquatic vehicle: it is just necessary to wind or unwind the wire, according to the case.

DETAILED DESCRIPTION OF AN EXEMPLARY EMBODIMENT

Figure 2:
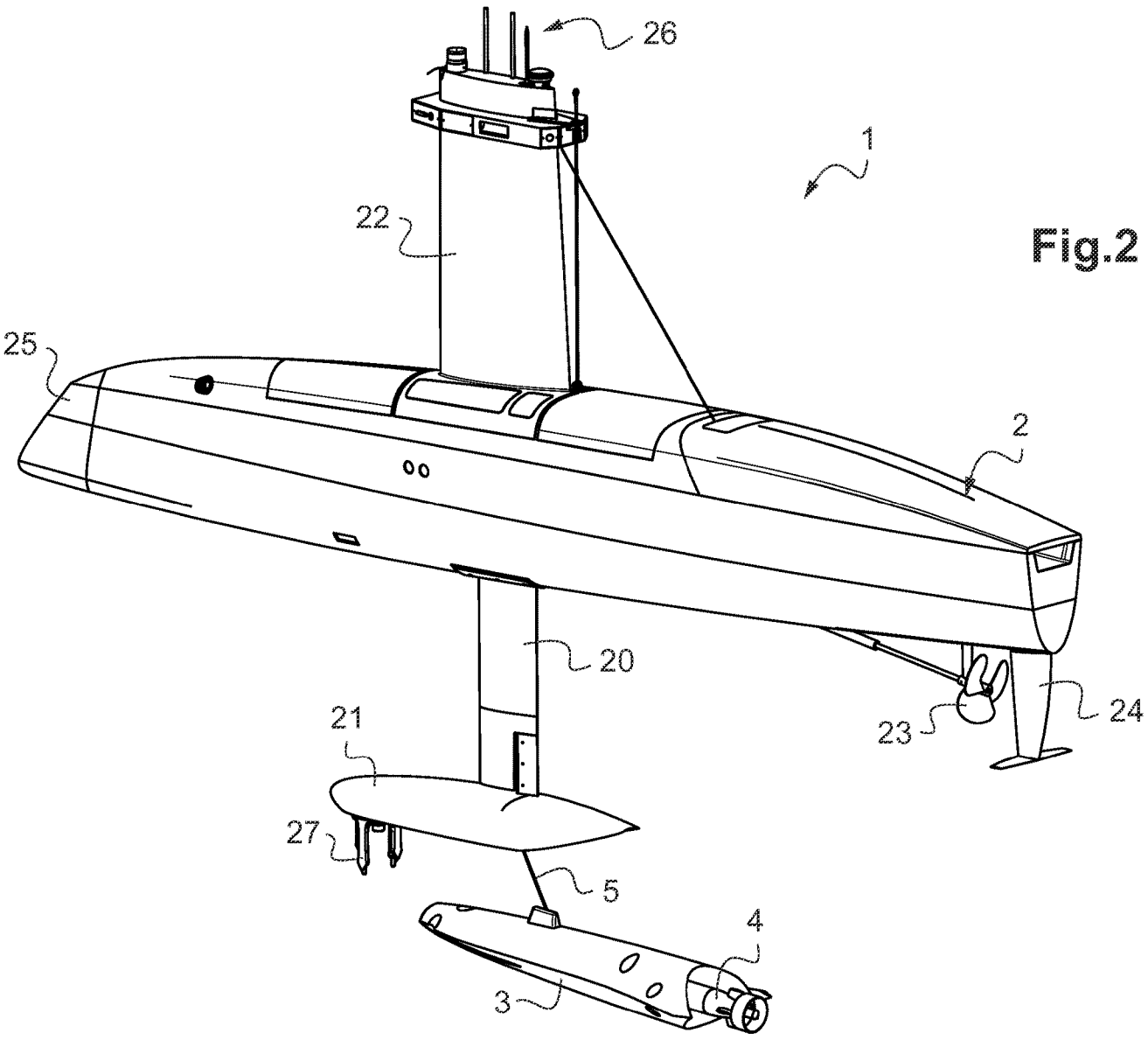
Figure 3:
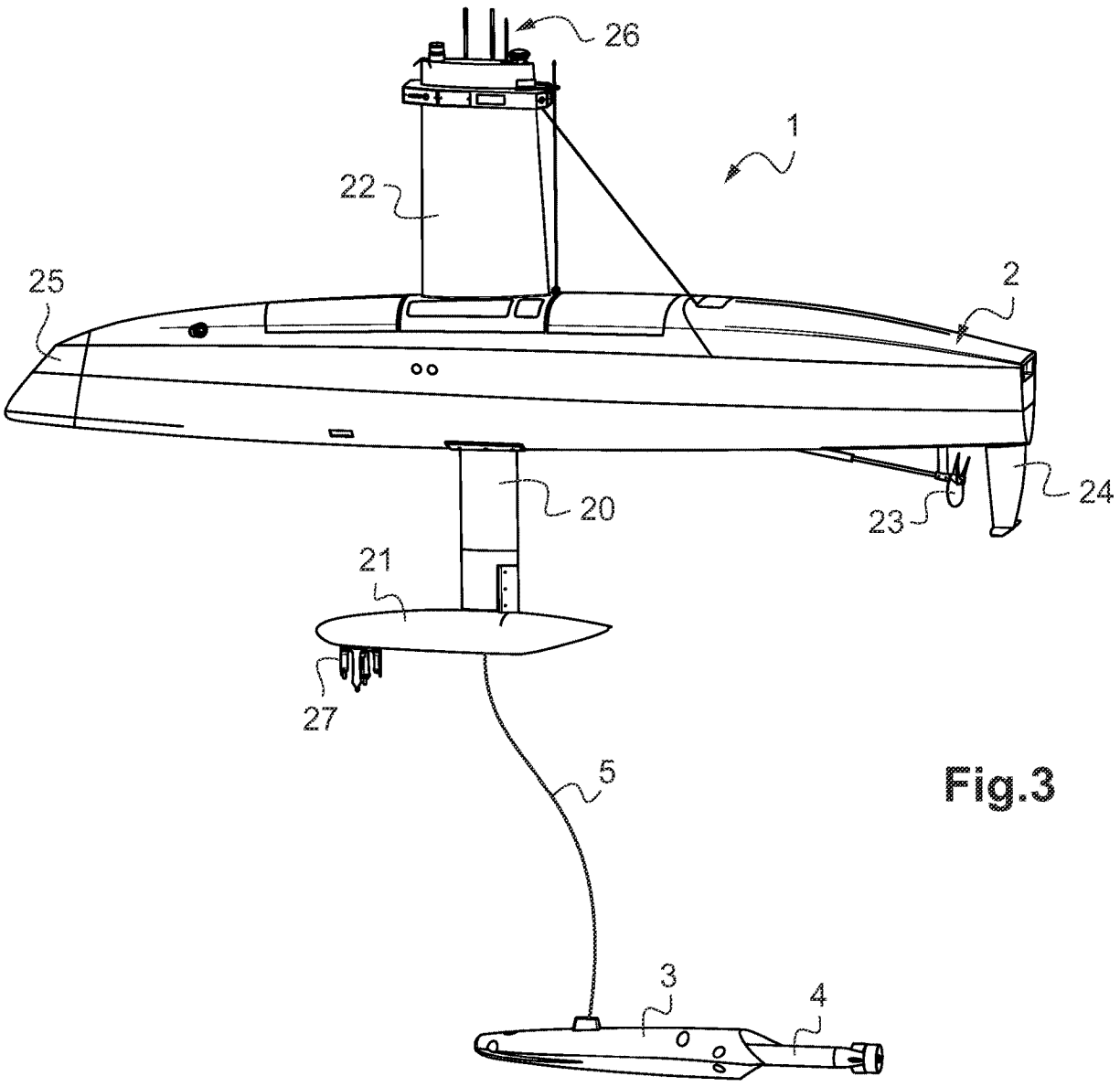
Figure 4:
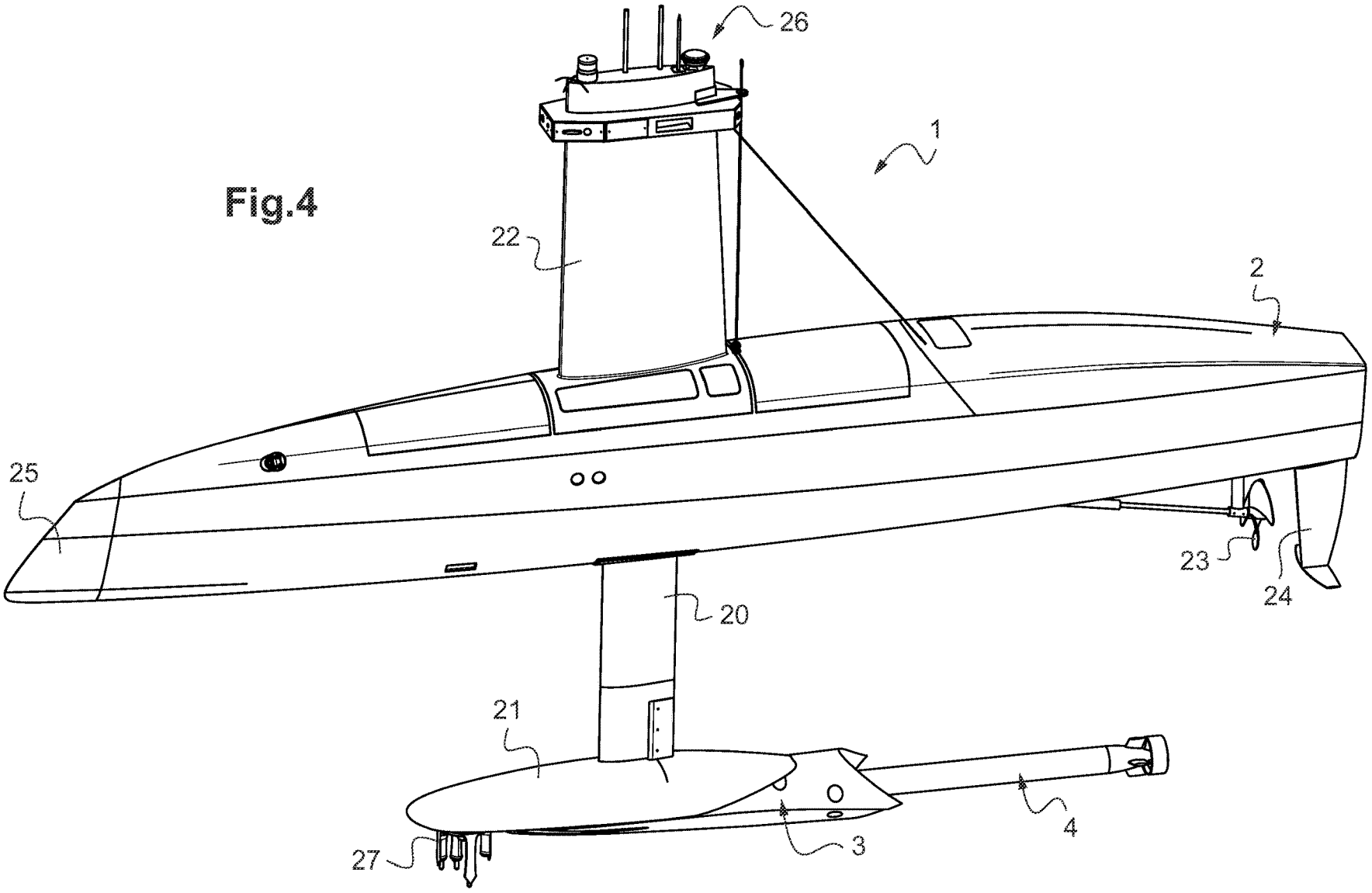
Figure 5:
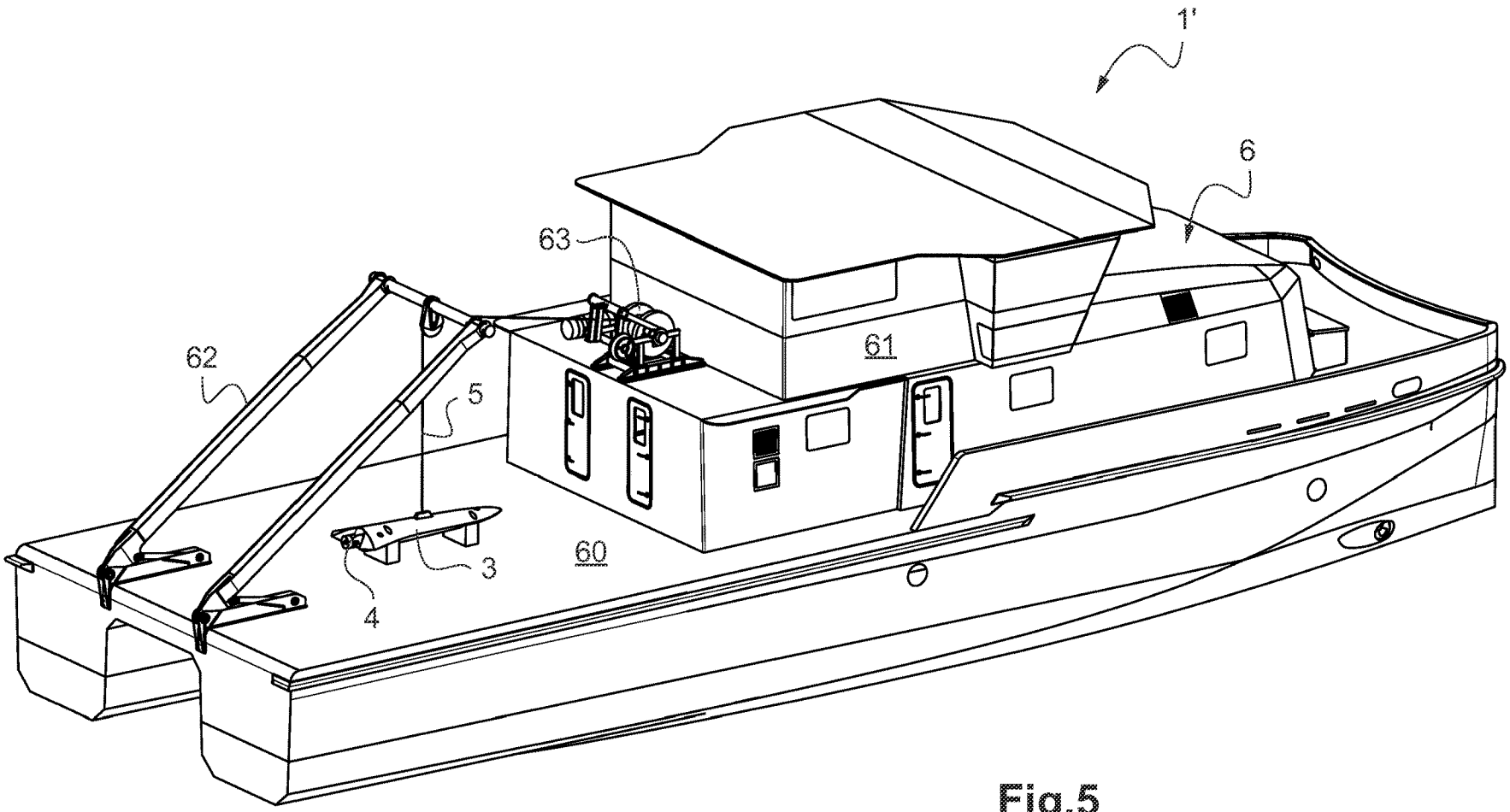
Figure 6:
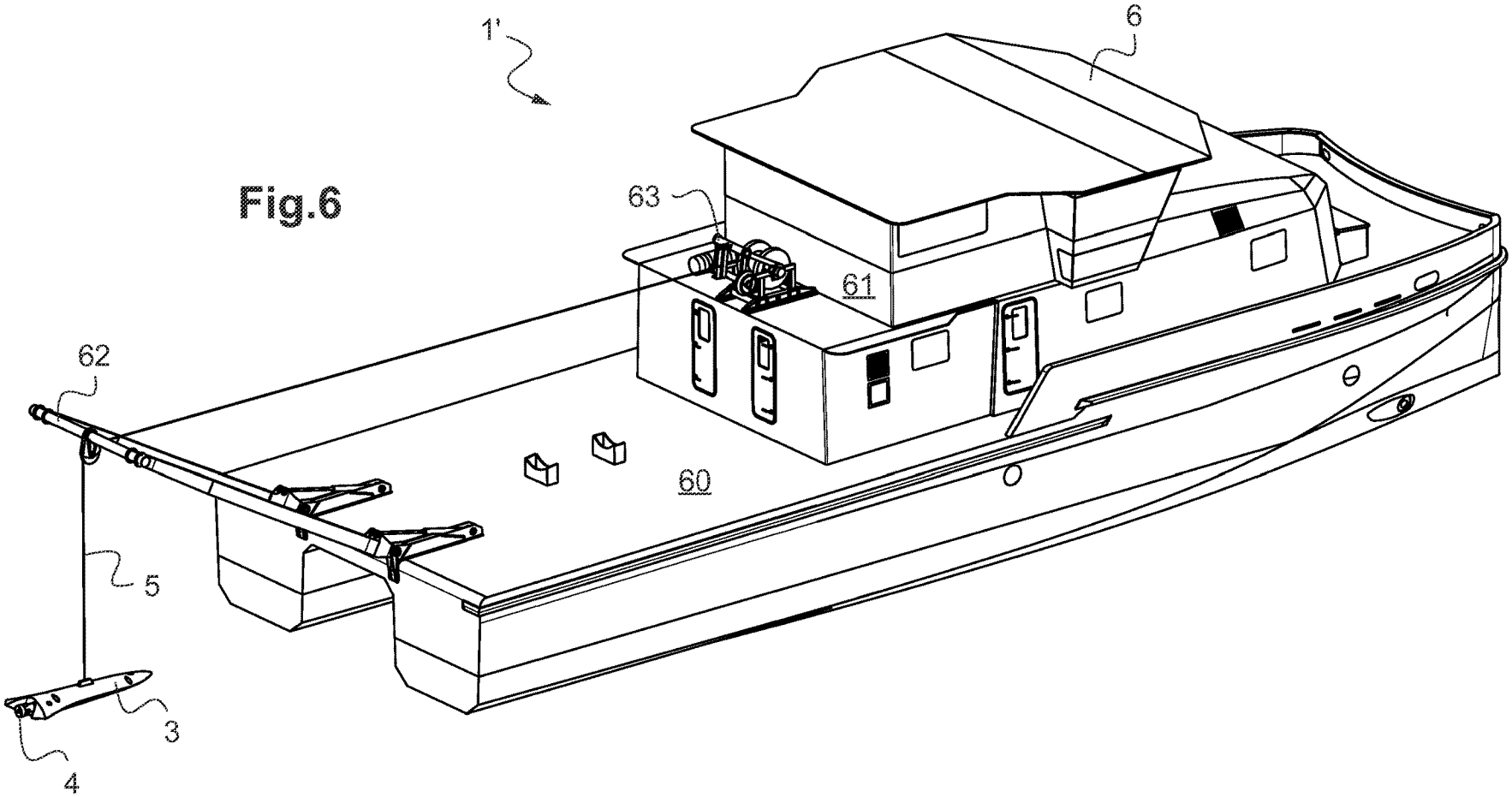
Figure 7:
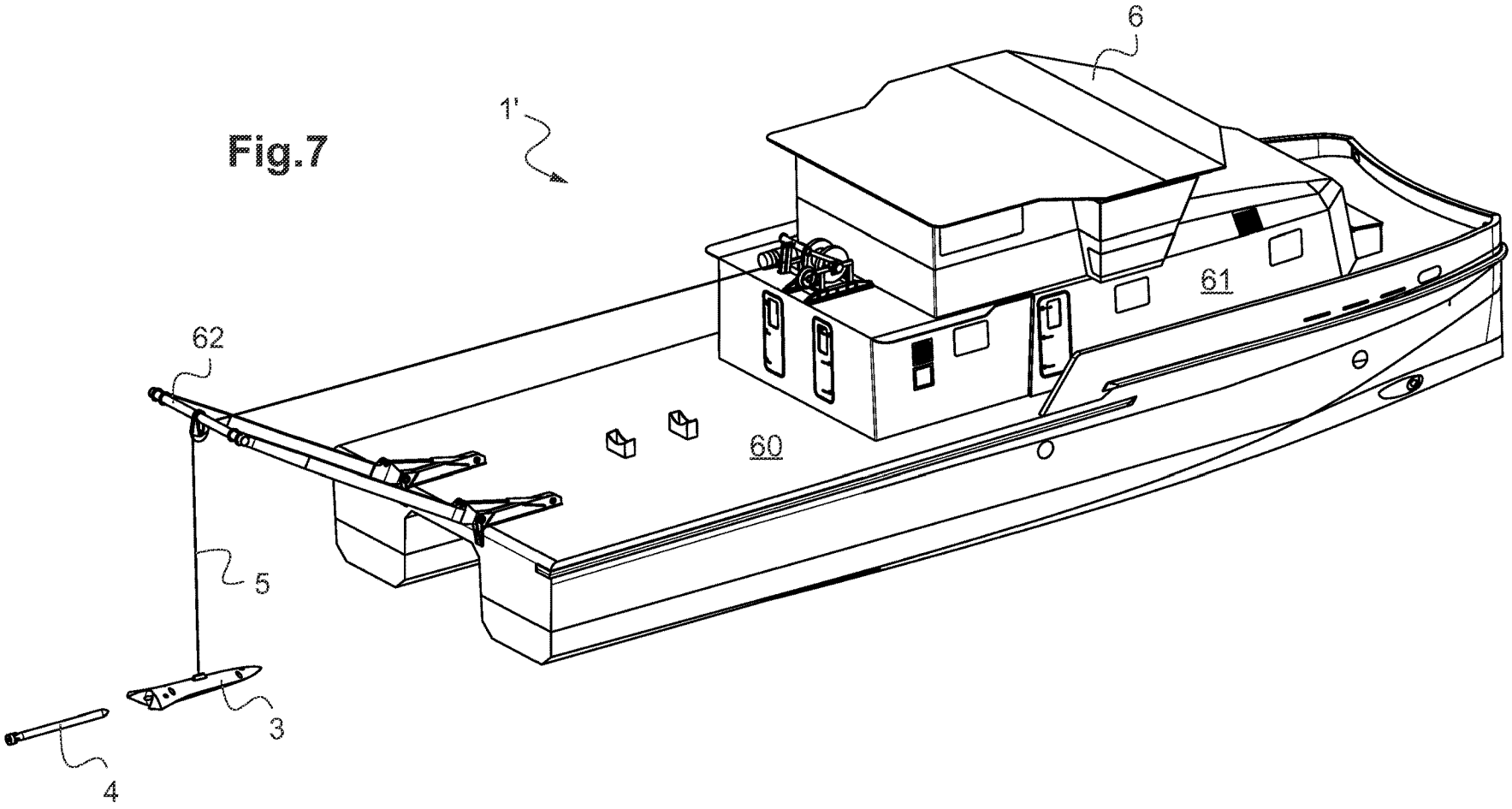
Figure 8:
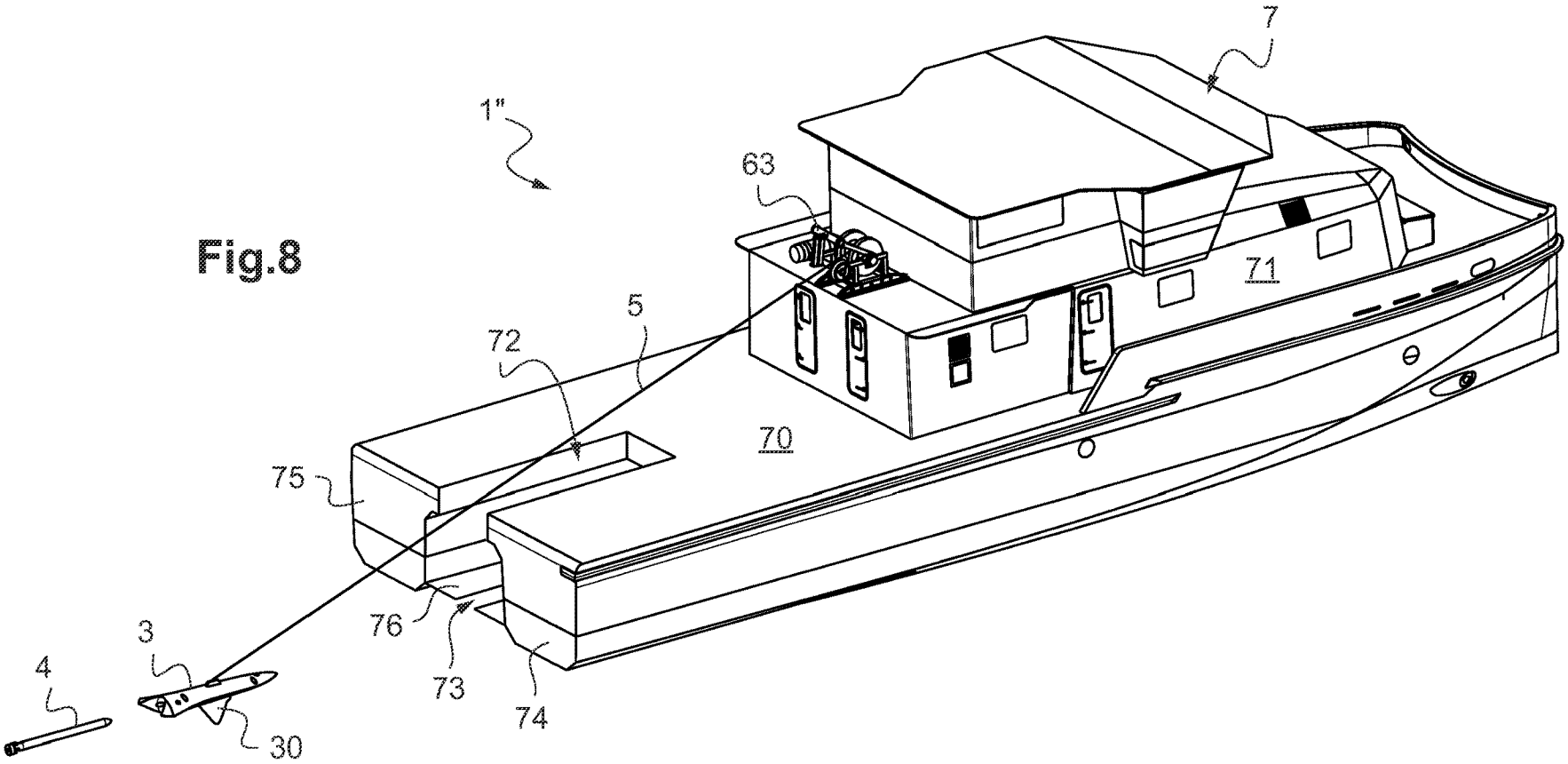
Figure 9:
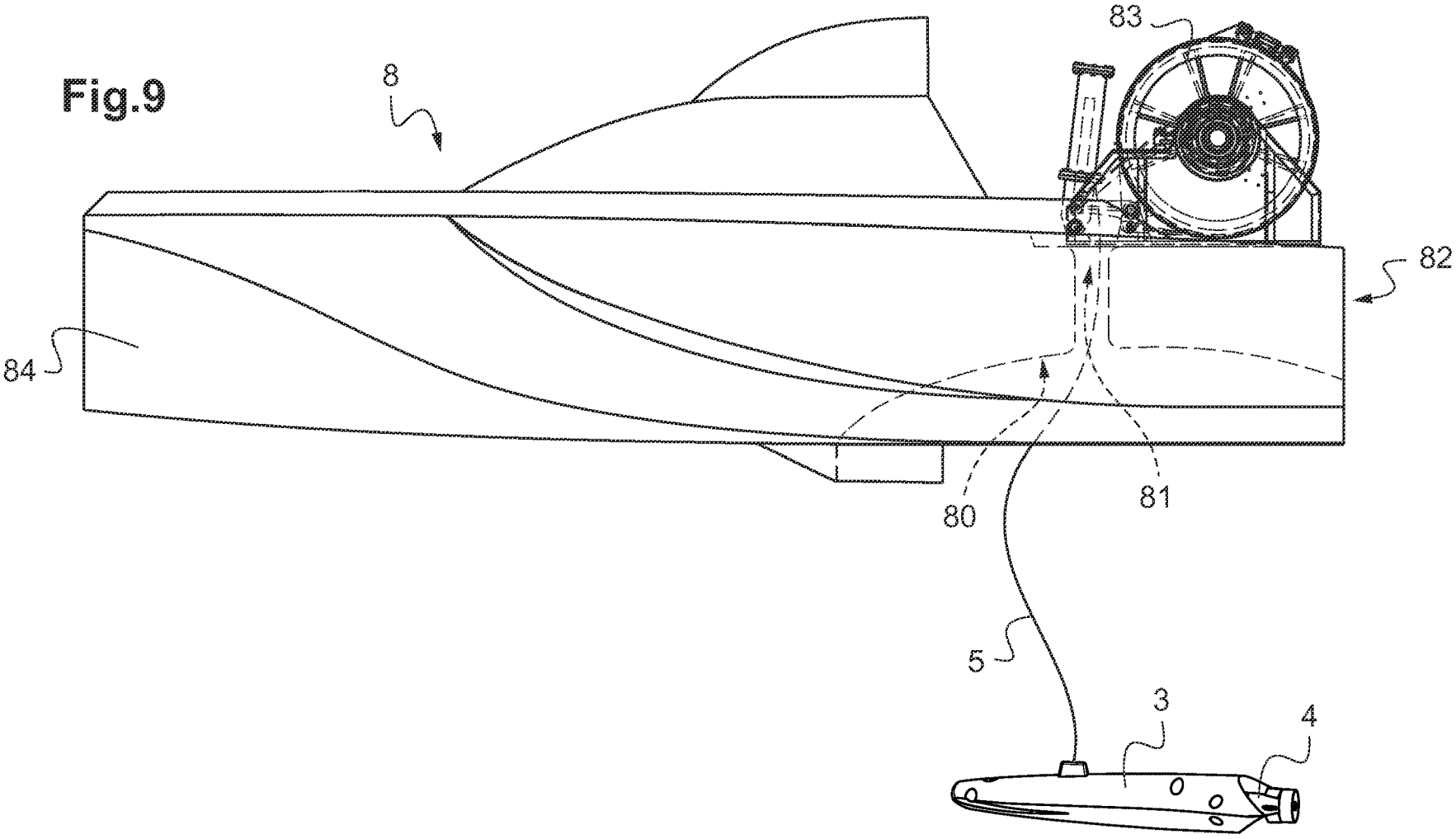
Figure 10:
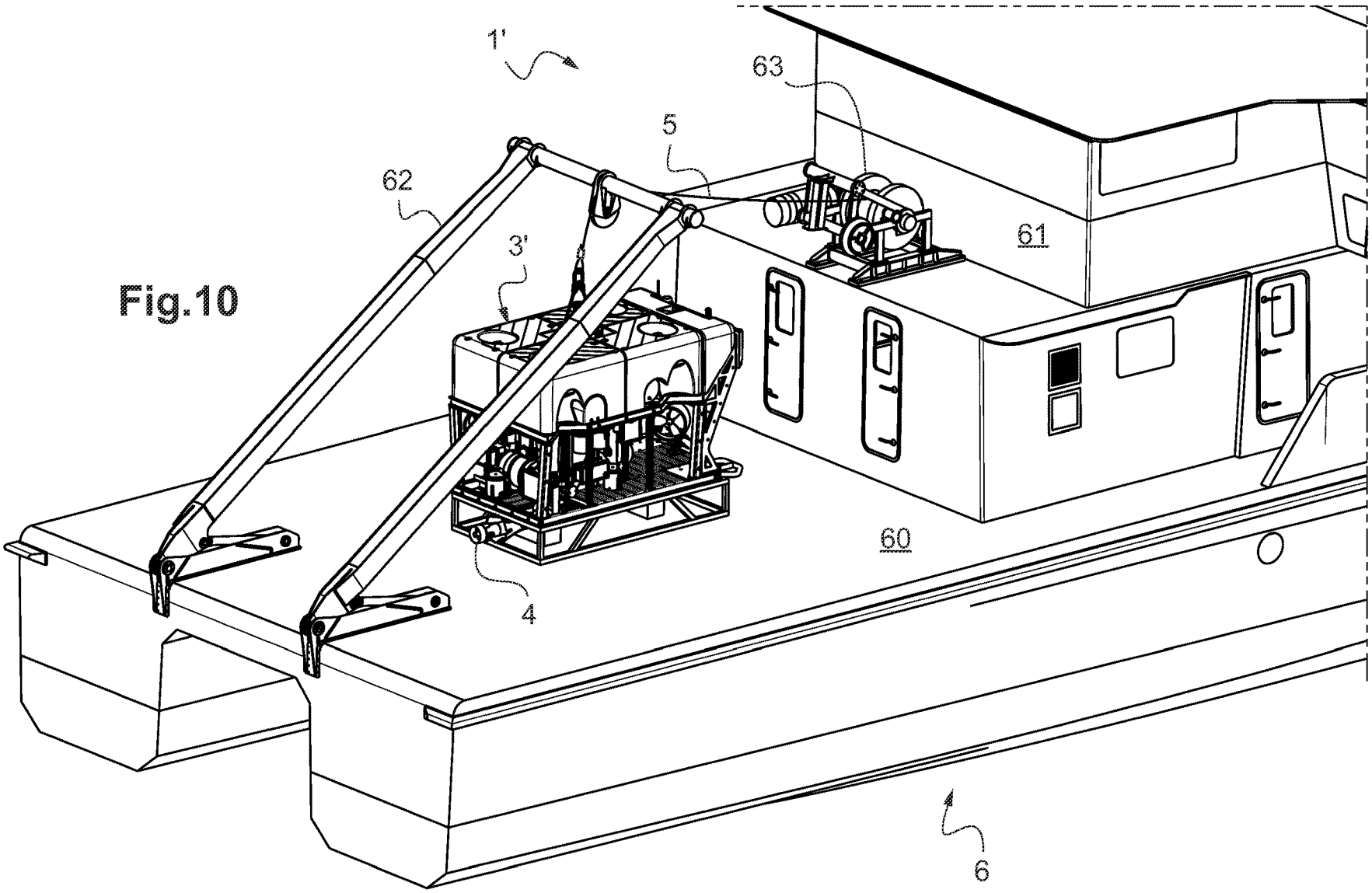
Figure 11:
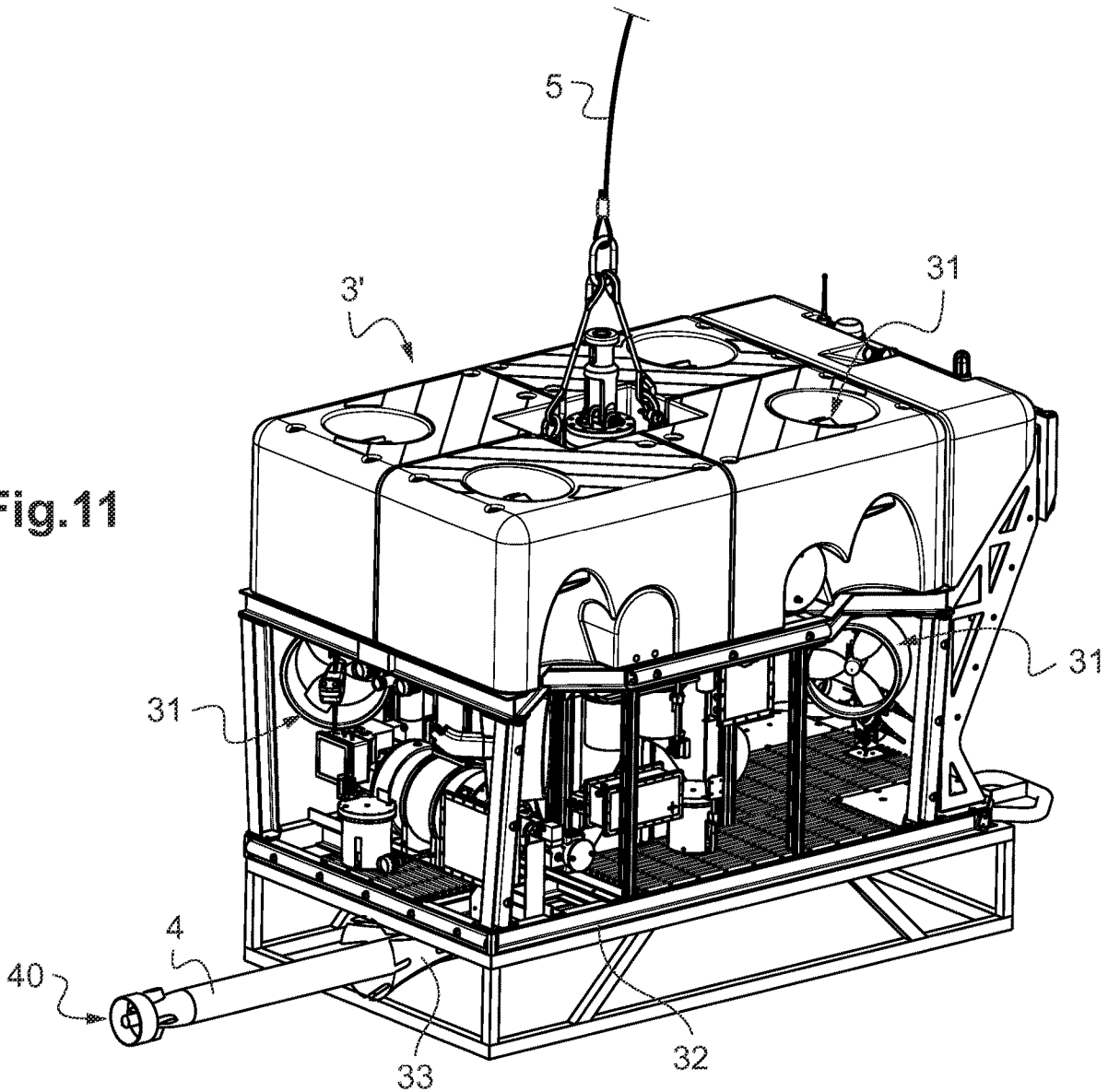

The following description in relation with the appended drawings, given by way of non-limitative examples, will allow a good understanding of what the invention consists of and of how it can be implemented. In the appended drawings:

FIG. 1 shows a first example of a system according to the invention with a keeled wave-piercing carrier ship, in the subaquatic vehicle storage configuration, the latter carrying/transporting its autonomous underwater vehicle, FIG. 2 shows the first example of a system in course of launching for use, the subaquatic vehicle with its autonomous underwater vehicle being separated from the carrier ship, while remaining connected thereto by a wire, to be wire-guided, FIG. 3 shows the first example of a system in course of launching for use, the subaquatic vehicle being separated from the carrier ship while remaining connected thereto by a wire, to be wire-guided, but this time with the autonomous underwater vehicle in course of separation from or docking with the subaquatic vehicle, FIG. 4 shows, for the first example of a system, another embodiment of launching, this time with the subaquatic vehicle in storage configuration during the separation from or the docking with the subaquatic vehicle, FIG. 5 shows a second example of a system according to the invention with a carrier ship including a device for recovering the subaquatic vehicle, allowing the latter to be taken out of water in the storage configuration, FIG. 6 shows the second example of a system according to the invention in course of launching, the subaquatic vehicle with its autonomous underwater vehicle being separated from the carrier ship and having been launched to water, FIG. 7 shows the second example of a system according to the invention in course of launching, but this time with the subaquatic vehicle separated from the autonomous underwater vehicle, FIG. 8 shows a third example of a system according to the invention with a carrier ship having a submerged bottom allowing the subaquatic vehicle to be recovered into a inner space of the carrier ship, the inner space being submerged at least in its rear portion, FIG. 9 shows a fourth example of a system according to the invention with a carrier ship having a hull with a bottom including a recess for the storage of the subaquatic vehicle against the hull, FIG. 10 shows a system derived from the second example in which the subaquatic vehicle is of a different type, with no hull, and is a an open chassis/frame structure, the subaquatic vehicle with its autonomous underwater vehicle being stored on the deck of the carrier ship, in storage configuration, and FIG. 11 shows a partial enlarged view of an implementation of the system of FIG. 10, this time in use configuration, the autonomous underwater vehicle being in course of launching (or, conversely, of recovery).

DEVICE

FIG. 1 shows a first example of a system 1 whose carrier ship 2 is a single-hull wave-piercing surface ship and that includes a keel 20 intended to stabilize it. With respect to the conventional mechanical propulsion ships that do not need one, and in particular high-speed ships for which it would be a handicap, the single-hull wave-piercing carrier ship 2 includes a keel 20 that is useful for its stability due to the fact that it has a very tapered/spindle shape contrary to the conventional mechanical propulsion ships. This single-hull wave-piercing carrier ship is in particular intended for making acoustic measurements in water and is not intended to "fly" above water, its keel including, in addition to the transported subaquatic vehicle, measurement devices that have to stay in water. It must hence be able to pierce the waves thanks to a blade-shaped bow 25, while navigating at a high speed and with a reduced energy consumption.

This carrier ship 2 is unmanned and autonomous because it is preprogramed and/or remotely operated/remote-controlled as regards in particular its navigation. It includes integrated navigation means that are particularly useful in the case of a drone.

In this first example, the carrier ship 2 has a removable keel that includes at its submerged, lower end, a gondola 21 forming a storage area for a subaquatic vehicle 3. Sensors, in particular acoustic ones 27, are attached against the gondola 21. In a variant, the gondola can be replaced by a bulb containing or supporting underwater measurement devices, wherein the bulb then contains the storage area of the subaquatic vehicle 3. In FIG. 1, an autonomous underwater vehicle 4 is installed in the subaquatic vehicle 3. Such a configuration in which the subaquatic vehicle 3 is stored on the carrier ship can correspond to a end of mission/use or to a displacement towards an area of use where the autonomous underwater vehicle 4 will be released.

The carrier ship 2 includes propelling means, herein provided with a propeller 23, and a guiding device 24 of the rudder type. The carrier ship 2 includes a wheelhouse 22 out of water, above the waterline, with devices 26 intended in particular for measurements and/or communications, in particular in the case where the carrier ship would be radio-controlled.

The keel 20 is removable and can be lifted and lowered through a keel well of the carrier ship hull. It is to be noted that the wheelhouse 22 is in the axis of the keel 20 and this wheelhouse further serves to house internally the upper end of the keel 20 lifted into a keel storage space of the wheelhouse.

In a variant, it may be provided in the hull or bottom, in the region of the keel 20, a recess making is possible to receive, when the keel is lifted, at least in part the gondola 21 or the bulb as well as, potentially, the subaquatic vehicle 3 and its autonomous underwater vehicle 4, and preferably, in such a way to be within the general volume of the hull and to reduce the resistance to forward motion of the carrier ship in the subaquatic vehicle 3 storage configuration.

In FIG. 2, the system 1 is switched to the use configuration in which the subaquatic vehicle 3 is separated from the carrier ship 2. A connection wire 5 connects the carrier ship 2 to the subaquatic vehicle 3 so that the latter is remotely operated/wire-guided. This figure may correspond to the beginning of use and the autonomous underwater vehicle 4 will then be released, or to the end of use after recovery of the autonomous underwater vehicle 4 into the subaquatic vehicle 3, the system then switching to the storage configuration when the subaquatic vehicle 3 will be attached again to the carrier ship 2.

In FIG. 3, the system 1 is always in use configuration and this time the autonomous underwater vehicle 4 is released from the subaquatic vehicle 3 or, conversely, comes back into the latter to be recovered.

FIG. 4 shows a variant in which the release or the recovery of the autonomous underwater vehicle 4 may be made whereas the subaquatic vehicle is attached to the carrier ship as in the storage configuration. This variant may be used in the case where the carrier ship is not subjected to movements, i.e. it is on a stretch of calm water, with no waves or swell.

The autonomous underwater vehicle 4 is, as its name indicates, a device that moves independently of the subaquatic vehicle 3 when released, contrary to the subaquatic vehicle 3 that remains connected by a wire to the carrier ship. The autonomous underwater vehicle 4 hence includes propelling means, provided with a propeller in this example, and guiding means as well as, preferably, stabilizing means. The actions of the propelling, guiding and possibly stabilizing means of the autonomous underwater vehicle are preprogramed and/or remotely operated/remote-controlled. These actions may also depend on measurements performed by sensors.

The propelling and guiding means of the autonomous underwater vehicle may be either distinct or combined, in this latter case, these means may be steerable propellers. It may also be provided the possibility to invert the direction of rotation of the propeller or of the turbine of the propelling, and possibly guiding, device.

The subaquatic vehicle 3 includes propelling and guiding means, for example steerable, of the jet/reaction turbine or variable jet deflection type, as well as stabilizing means allowing a stabilization of the subaquatic vehicle according to three axes.

It is understood that, if the propelling, guiding and stabilizing means, for each of the carrier ship, the subaquatic vehicle and the autonomous underwater vehicle, have been separated as regards their description to facilitate the explanation of the different functions, but in practice and materially, these different propulsion/displacement, guiding/steering, stabilization functions can be carried out with one or several devices each performing several of these functions. Hence, as seen hereinabove, a same steerable propelling device provided with a propeller or a turbine may serve as a propelling, guiding and stabilizing means. A ballast system may serve to the passive displacement, in particular lowering or lifting displacement, and to the passive steering of the subaquatic vehicle or of the autonomous underwater vehicle.

FIG. 5 shows a second example of a system 1' whose carrier ship 6 is a more conventional surface ship, herein a two-hull ship, of the catamaran type, but, in a variant, it may be of the single-hull type. This time, in the storage configuration, the subaquatic vehicle 3 is lifted, out of the water, on the deck 60 of the carrier ship 6. This carrier ship 6 includes a superstructure 61 intended to a crew for sailing.

The carrier ship 6 includes a subaquatic vehicle recovery device for taking said subaquatic vehicle out of water and, inversely, launching it to water. This recovery device is a gantry 62 and a motorized winch 63 for winding and unwinding the connection wire 5 between the subaquatic vehicle 3 and the carrier ship 6. This gantry recovery device 62 also allows the launching of the subaquatic vehicle to water.

In the use configuration of FIG. 6, the subaquatic vehicle 3 has been launched to water and the autonomous underwater vehicle 4 is installed in the docking station of the subaquatic vehicle. In FIG. 7, the autonomous underwater vehicle 4 has been released.

FIG. 8 shows a third example of a system 1" whose carrier ship 7 is a peculiar surface ship in that it includes a submerged/sunk bottom 76 that includes a slot 73 in which an axial wing 30, herein a lower one, of the subaquatic vehicle can slide. According to the depth of the submerged bottom 76, the vehicle may remain subaquatic in storage configuration. The two floating lateral edges 74 and 75 of the carrier ship 7 define with the bottom 76 a submerged inner space 72, open towards the rear, for the storage of the subaquatic vehicle 3 and of its autonomous underwater vehicle 4. A subaquatic vehicle 3 can be provided, which can surface and float in the case where the depth of the bottom 76 would be smaller. In a variant, the subaquatic vehicle 3 is stored under the bottom 76, under the hull of the carrier ship, and the axial wing is a higher wing that may slide in the slot 73. In this latter case, the bottom 76 can be configured so as to form a recess of the bottom into which the subaquatic vehicle is received.

In variants, the partially submerged bottom is a launch and recovery ramp and, in storage configuration, the subaquatic vehicle can be totally taken out of water through the ramp or, only its front portion can be taken out of the water, the latter case being useful if it is desired to use the propelling, and possibly guiding means, of the subaquatic vehicle, to drive the carrier ship or help it to move, the propelling means of the subaquatic vehicle, but also of the autonomous underwater vehicle, remaining in water.

As hereinabove, the carrier ship 6 of FIG. 8 includes a deck 70 and a superstructure 71 intended to a crew for sailing. It may be provided, on the rear of the carrier ship, one or several doors to close the inner space towards the rear.

In variants of this third example of a system 1", the floating lateral edges 74, 75 may be consisted of inflatable bladders making it possible to make a dismountable and foldable carrier ship.

In the fourth example of a system shown in FIG. 9, the carrier ship 8 includes a hull 84 whose bottom includes a recess 80 making it possible to store the subaquatic vehicle 3 against the keel/bottom in the storage configuration, the subaquatic vehicle being further able, in certain embodiments, to participate to the propulsion of the carrier ship, in particular in the case where the rear wall 82 of the carrier ship is open at the recess. Preferably, the connection wire coming from the carrier ship arrives through a cable well 81 into the recess in the case where it arrives at the top of the subaquatic vehicle but, in other embodiments, it may follow another way, in particular if the cable arrives on the subaquatic vehicle by the front or the underside. A winder/unwinder 83 for the connection wire 5 is arranged on the deck of the carrier ship.

The subaquatic vehicle described by way of example until now if the hull type but, in other embodiments, this subaquatic vehicle 3' may have a different structure, and in particular, as shown in FIGS. 10 and 11, be of the chassis/frame 32 and open structure type. FIGS. 10 and 11 show the propelling, guiding and stabilizing means, and in particular the steerable propellers 31 inside the chassis 32 of the open structure of the subaquatic vehicle 3'. The inner equipment of the subaquatic vehicle 3' is also visible within this open structure. In order to facilitate the automatic recovery of the autonomous underwater vehicle within the docking station that includes an automated docking system, the mouth 33 of the docking station has a funnel shape which is better seen in FIG. 11.

Method

The system of the invention allows the launching and recovery of an autonomous underwater vehicle using a surface carrier ship, in optimum conditions, because the launching and above all the recovery are carried out whereas the autonomous underwater vehicle is under the water surface and is hence not subjected to the wave or swell movements, contrary to the carrier ship. For that purpose, a subaquatic vehicle that allows transporting the autonomous underwater vehicle is implemented. For these operations, it is hence necessary that the subaquatic vehicle is itself submerged, under the surface of the water, and, preferably, when the carrier ship wiggles, that the subaquatic vehicle is uncoupled/separated from the carrier ship.

The autonomous underwater vehicle 4 is configured to dock with and enter at least in part the wire-guided subaquatic vehicle 3, the latter being held in a stable attitude during this operation. This docking operation may also be performed whereas the carrier ship and the autonomous underwater vehicle are in motion, and it is provided a docking at speeds up to 7 knots.

Hence, in the case of the system 1' of the second example, in which the subaquatic vehicle with its autonomous underwater vehicle is stored out of water, on the deck of the carrier ship, in storage configuration, the subaquatic vehicle with its autonomous underwater vehicle must first be launched to water thanks to the recovery/launching device with its gantry 62 and the motorized winch 63 of the carrier ship. After launching to water, the subaquatic vehicle is wire-guided thanks to the wire 5 and it is brought in submersion at the location where it is desired to release the autonomous underwater vehicle from the subaquatic vehicle. Once the autonomous underwater vehicle released, the latter can perform the missions that have been planed for it. Once these missions terminated, the autonomous underwater vehicle can automatically dock with the docking station of the subaquatic vehicle for its recovery, whereas the subaquatic vehicle is submerged. For this automatic docking, complementary automated docking means are implemented between the subaquatic vehicle and the autonomous underwater vehicle.

In the examples shown, only one autonomous underwater vehicle 4 per subaquatic vehicle 3 is shown, but two or more of them can be provided. Likewise, only one subaquatic vehicle 3 has been shown per carrier ship 2, 6, 7, but two or more of them can be provided. Other embodiments are possible. If, preferably and as shown, the autonomous underwater vehicle 4 docks with or leaves the subaquatic vehicle 3 through the rear of the latter, it may be provided a lateral or front docking with the subaquatic vehicle 3. However, physical means are provided so that the system has a small resistance to forward motion and/or under water and, for that purpose, it may be provided a removable door to close the autonomous underwater vehicle docking station with which the autonomous underwater vehicle 4 docks. Likewise, the bulb and the gondola, just as the subaquatic vehicle, have hydrodynamic shapes.

The invention claimed is:

1. A system (1, 1', 1") for launching and recovering an autonomous underwater vehicle (4) using a surface carrier ship (2, 6, 7), the carrier ship (2, 6, 7) including a hull with a bottom, the autonomous underwater vehicle (4) including a body elongated in the length direction and propelling, guiding and stabilizing means, wherein the propelling, guiding and stabilizing means of the autonomous underwater vehicle (4) make it possible to control displacements according to six degrees of freedom, the system including, in addition to the carrier ship (2, 6, 7), a subaquatic vehicle (3) wire-guided by a connection wire (5) connected to the carrier ship (2, 6, 7), wherein the subaquatic vehicle (3) can be positioned in two main configurations, a storage configuration in which the subaquatic vehicle (3) is removably attached to the carrier ship (2, 6, 7) in a storage area of the carrier ship and a use configuration in which the subaquatic vehicle, separated from the carrier ship (2, 6, 7), is in water and remote from the storage area of the carrier ship while remaining connected to the carrier ship (2, 6, 7) by the connection wire (5), said subaquatic vehicle (3) including propelling, guiding and stabilizing means, the propelling, guiding and stabilizing means of the subaquatic vehicle making it possible to control the displacements according to six degrees of freedom, and said subaquatic vehicle (3) including a docking station for the autonomous underwater vehicle (4), allowing a removable attachment of the autonomous underwater vehicle (4) to the subaquatic vehicle (3) for transporting the autonomous underwater vehicle (4) to a launching location, where the autonomous underwater vehicle will be released from the subaquatic vehicle (3), the subaquatic vehicle and the autonomous underwater vehicle (4) including complementary automated docking means allowing the launched autonomous underwater vehicle (4) to automatically dock with the docking station of the subaquatic vehicle (3) during the recovery and to attach thereto, wherein said subaquatic vehicle includes a payload enclosure, the payload enclosure including the docking station for the autonomous underwater vehicle, the autonomous underwater vehicle engaging at least partially inside the payload enclosure, the partially engaged rear portion of the autonomous underwater vehicle exiting from said enclosure, said subaquatic vehicle having a substantially elongated spindle general shape, wherein the storage area is chosen among:

a submerged recess of the bottom of the carrier ship (2, 6, 7) hull, the subaquatic vehicle remaining submerged in storage configuration, against the hull and under the carrier ship (2, 6, 7), and a submerged end of an appendix of the carrier ship hull, the submerged appendix of the carrier ship (2, 6, 7) being a keel (20) and the subaquatic vehicle being stored at the lower end of the keel (20).

2. The system (1, 1', 1") according to claim 1, wherein the keel (20) includes at its lower end a bulb or a gondola (21), the bulb or the gondola (21) including a recess intended for the storage of the subaquatic vehicle (3).

3. The system (1, 1', 1") according to claim 2, wherein the carrier ship (2) is a single-hull wave-piercing ship.

4. The system (1, 1', 1") according to claim 2, wherein the keel (20) is removable and may be lifted at least in part through the hull by translation from the bottom to the top or, inversely, lowered under the hull.

5. The system (1, 1', 1") according to claim 4, wherein the carrier ship (2) is a single-hull wave-piercing ship.

6. The system (1, 1', 1") according to claim 1, wherein the keel (20) is removable and may be lifted at least in part through the hull by translation from the bottom to the top or, inversely, lowered under the hull.

7. The system (1, 1', 1") according to claim 6, wherein the carrier ship (2) is a single-hull wave-piercing ship.

8. The system (1, 1', 1") according to claim 1, wherein the carrier ship (2) is a single-hull wave-piercing ship.

9. The system (1, 1', 1") according to claim 1, wherein the keel (20) is removable and may be lifted at least in part through the hull by translation from the bottom to the top or, inversely, lowered under the hull and wherein the carrier ship (2, 6, 7) includes, on a bottom thereof, the recess intended for the storage of the subaquatic vehicle, the subaquatic vehicle remaining submerged in storage configuration, against the hull and under the carrier ship (2, 6, 7).

10. A method for launching and recovering an autonomous underwater vehicle (4) using a surface carrier ship (2, 6, 7), the carrier ship (2, 6, 7) including a hull with a bottom, the autonomous underwater vehicle (4) including a body elongated in the length direction and propelling, guiding and stabilizing means, wherein the propelling, guiding and stabilizing means of the autonomous underwater vehicle (4) make it possible to control displacements according to six degrees of freedom, the method implementing a subaquatic vehicle (3) wire-guided by a connection wire (5) connected to the carrier ship (2, 6, 7), said subaquatic vehicle (3) including propelling, guiding and stabilizing means, wherein the propelling, guiding and stabilizing means of the subaquatic vehicle make it possible to control displacements according to six degrees of freedom, said subaquatic vehicle (3) including a docking station for the autonomous underwater vehicle (4) allowing a removable attachment of the autonomous underwater vehicle (4) to the subaquatic vehicle (3), wherein the subaquatic vehicle (3) can be positioned in two main configurations, a storage configuration in which the subaquatic vehicle (3) is removably attached to the carrier ship (2, 6, 7) in a storage area of the carrier ship and a use configuration in which the subaquatic vehicle (3), separated from the carrier ship (2, 6, 7), is in water and remote from the storage area of the carrier ship while remaining connected to the carrier ship (2, 6, 7) by the connection wire (5), and, for the launching, the autonomous underwater vehicle (4) is released from the docking station when the subaquatic vehicle (3) is submerged and in use configuration, and for the recovery, the autonomous underwater vehicle (4) is automatically recovered into the docking station when the subaquatic vehicle (3) is submerged and in use configuration, the subaquatic vehicle and the autonomous underwater vehicle (4) including automated complementary docking means allowing the launched autonomous underwater vehicle (4) to automatically dock with the docking station of the subaquatic vehicle (3), wherein a subaquatic vehicle (3) including a payload enclosure is implemented, the payload enclosure including the docking station for the autonomous underwater vehicle, the autonomous underwater vehicle engaging at least partially inside the payload enclosure, the partially engaged rear portion of the autonomous underwater vehicle exiting from said enclosure, said subaquatic vehicle having a substantially elongated spindle general shape, and wherein the storage area is chosen among:

a submerged recess of the bottom of the carrier ship (2, 6, 7) hull, the subaquatic vehicle remaining submerged in storage configuration, against the hull and under the carrier ship (2, 6, 7), and a submerged end of an appendix of the carrier ship hull, the submerged appendix of the carrier ship (2, 6, 7) being a keel (20) and the subaquatic vehicle being stored at the lower end of the keel (20).

* * * * *